US007249947B2

(12) United States Patent
Papai

(10) Patent No.: US 7,249,947 B2
(45) **Date of Patent: *Jul. 31, 2007**

(54) VENTING CHASSIS FOR A CONTAINERIZED CANDLE

(75) Inventor: Tod A. Papai, New Carlisle, IN (US)

(73) Assignee: Smith Mountain Industries, Inc.

( * ) Notice: Subject to any disclaimer, the term of this patent is extended or adjusted under 35 U.S.C. 154(b) by 186 days.

This patent is subject to a terminal disclaimer.

(21) Appl. No.: 10/868,418

(22) Filed: Jun. 15, 2004

(65) Prior Publication Data

US 2005/0277078 A1 Dec. 15, 2005

(51) Int. Cl.
*F23D 3/18* (2006.01)
*F23L 19/00* (2006.01)
*F21V 37/02* (2006.01)
*F21V 35/00* (2006.01)

(52) U.S. Cl. ..... 431/289; 431/291; 362/161

(58) Field of Classification Search ..... 431/126, 431/288, 289, 291, 300, 310; 362/159, 161, 362/163, 171, 172, 173, 180, 182, 266, 312, 362/313, 362, 363, 373; 126/1 R, 43, 44, 126/45, 248, 255, 256, 257, 258, 260, 259 R, 126/259 M See application file for complete search history.

(56) References Cited

U.S. PATENT DOCUMENTS 212,603 A * 2/1879 Irwin ..... 362/171
439,672 A * 11/1890 Miller ..... 362/180
493,495 A * 3/1893 Miller ..... 362/180
569,572 A * 10/1896 Funck ..... 362/182
592,705 A * 10/1897 Bourne ..... 362/182
698,053 A * 4/1902 Prahm ..... 362/182
813,885 A * 2/1906 Handle ..... 362/182
878,518 A * 2/1908 Fresh ..... 362/182
1,011,779 A * 12/1911 Harrington ..... 362/182
1,022,821 A * 4/1912 Briand ..... 362/182
1,039,123 A * 9/1912 Hamm ..... 362/182
1,097,464 A * 5/1914 Prahm ..... 362/182
1,162,682 A * 11/1915 Cherry ..... 422/126
1,490,341 A * 4/1924 Olney ..... 40/311
1,568,465 A * 1/1926 Olsson ..... 362/171
1,705,877 A * 3/1929 Ramsey ..... 362/161
1,867,420 A * 7/1932 Root ..... 431/291
1,915,622 A * 6/1933 Sevcik ..... 431/291
1,975,496 A * 10/1934 Barrett, Jr. ..... 362/161
2,001,377 A * 5/1935 Candy, Jr. ..... 431/291
2,050,151 A * 8/1936 Baumer ..... 362/161
2,214,991 A * 9/1940 Candy, Jr. ..... 362/161

(Continued)

*Primary Examiner*—Carl D. Price
(74) *Attorney, Agent, or Firm*—R. Tracy Crump

(57) ABSTRACT

The venting chassis is designed to function optimally with jar candles that have small diameter mouths, and jar candles that have oddly shaped, non-cylindrical or smaller sized jars. The venting chassis includes an annular skirt that is dimensioned to extend below the jar shoulder that is formed between the sidewalls and jar brim. The skirt physically separates the inlet air flow from the exhaust air flow to facilitate laminar air flow within the jar candle. The skirt has three longitudinal depressions or channels, which form three inlet vents that open just below the shoulder. The skirt is shaped and configured to acts as a nozzle to constrain thereby increasing the velocity and inertia of the airflow and to vent the inlet airflow under the shoulder directly onto jar sidewalls thereby cooling the jar sidewalls.

3 Claims, 3 Drawing Sheets

U.S. PATENT DOCUMENTS

| | | | | |
|---|---|---|---|---|
| 2,274,823 | A * | 3/1942 | Candy, Jr. | 264/279 |
| 4,557,687 | A * | 12/1985 | Schirneker | 431/291 |
| 4,926,298 | A * | 5/1990 | Zimmerman | 362/163 |
| 6,231,336 | B1 * | 5/2001 | Chen | 431/291 |
| 6,382,962 | B1 * | 5/2002 | Papai | 431/291 |
| 6,585,510 | B2 * | 7/2003 | Papai | 431/291 |
| 6,589,047 | B1 * | 7/2003 | Papai | 431/291 |
| 6,629,836 | B2 * | 10/2003 | Campbell | 431/33 |
| 6,663,384 | B2 * | 12/2003 | Papai | 431/289 |
| 6,783,356 | B2 * | 8/2004 | Hermanson | 431/126 |
| 7,044,320 | B2 * | 5/2006 | Mladenovic | 220/23.87 |
| 2002/0031739 | A1 * | 3/2002 | Papai | 431/291 |
| 2002/0058223 | A1 * | 5/2002 | Papai | 431/288 |
| 2003/0129558 | A1 * | 7/2003 | Papai | 431/291 |
| 2004/0241603 | A1 * | 12/2004 | Papai | 431/291 |
| 2004/0265760 | A1 * | 12/2004 | Swearingen et al. | 431/125 |

* cited by examiner

VENTING CHASSIS FOR A CONTAINERIZED CANDLE

This invention relates to a venting chassis used with containerized candles for improving the candle's combustion and eliminating candle smoke, and in particular a venting chassis having a curved baffle for use with smaller non standard jar candles.

BACKGROUND OF INVENTION

U.S. Pat. Nos. 6,382,962, 6,585,510, 6,589,047, and 6,663,384 disclose various venting devices (plates and chassis) that are used atop containerized (jar) candles to improve combustion and reduce soot. The venting plates of U.S. Pat. No. 6,382,962 are flat discs that have several inlet vents radially spaced from a central exhaust vent so as to provide separated laminar inlet and exhaust air flows. The venting chassis of U.S. Pat. Nos. 6,585,510, 6,589,047, and 6,663,384 provide a substructure upon which various ornamentation and decorative reliefs are mounted, as well as facilitating laminar air flow within the jar candle. The ornamentation and decorative reliefs are bonded to the top of the venting chassis around a central chimney through which exhaust air is vented. The venting chassis is supported atop the candle by a number of feet which space the chassis over the brim of the candle to create an annular inlet vent. The venting chassis also include an internal baffle for physically separating the inlet and exhaust air flows within the vessel interior. The baffle directs inlet air flow downward into the interior of the candle through the inlet vent downward along the sidewalls of the vessel and separates the downward inlet air flow from the upward exhaust air flow. In addition to creating separated laminar inlet and exhaust airflows within jar candles, which improves combustion and reduces soot, these venting devices help regulate the surface temperature of the jar candle by venting cool inlet air downward along the jar sidewalls. This cooling function helps to insure that the jar candle can be safely handled and operated by a user.

The above mentioned venting devices are designed to work optimally with standard "three inch" apothecary jar candles. The descriptive term "three inch" refers to the diameter of the jar's mouth. In the candle industry, apothecary jars typically conform to certain basic dimensional standards whether constructed from blown or I.S. glass insure use with automated filling systems. The body diameter of a standard "three inch" apothecary jar is approximately 4.0 inches and the mouth diameter is approximately 3.26 inches (83 mm) for blown glass and 3.50 inches (89 mm) for I.S. glass. While varying in height three to six inches, the dimension of a typical apothecary jar varies very little, only a few tenths of an inch, particularly in the diameters of the body and mouth. Heretofore, while working optimally with standard three inch apothecary jar candles, these venting plates and venting chassis have not worked optimally with jar candles that have small diameter mouths, or jar candles that have oddly shaped, non-cylindrical or smaller sized jars.

The venting and cooling functions of the above mentioned venting devices are critically effected by the area, diameter and configuration of both the jar mouth and the jar interior. Small mouthed jar candles (typically diameters less than 3.26 inches) are particularly problematic simply because there is less area in which to separate the inlet airflow from the exhaust airflow. Because both inlet and exhaust air must both physically pass through the jar's mouth, smaller mouthed jar candles physically limit the venting device's capability to sufficiently separate the inlet and exhaust air flows. Non-cylindrical and oddly shaped jar candles also present significant venting problems, particularly jars with pronounced shoulders between the sidewalls and brim of the jars. In most candle jars, the brim of the jar mouth is inset some distance from the sidewall of the jar forming a pronounced shoulder interior. Because the skirts or baffles of conventional venting plates and chassis direct the inlet air flows directly downward, an air gap is formed beneath these pronounced shoulders in the jars and the cool inlet air flow is not vented directly out to the sidewalls from the inset jar mouth. Furthermore, conventional venting plates and chassis cannot direct inlet air flow back onto angled and curved sidewalls of the many oddly shaped jar candles that are available.

The cooling function provided by a venting device becomes more critical as the volume or the jar and the area of the jar mouth decreases. The smaller volume jar candles have less interior within which the thermal energy of the candle can be diffused. Consequently, the surface temperature of the jar, the melted wax pool and internal air temperature is higher in smaller jar candles than in standard three inch apothecary jar candles. In smaller sized jar candles, the surface temperature can often be too hot to touch and more even elevate to the flash point of the wax, presenting serious fire and safety hazards.

SUMMARY OF INVENTION

The venting chassis of this invention functions optimally with jar candles that have small diameter mouths, and jar candles that have oddly shaped, non-cylindrical or smaller sized jars. The venting chassis is specifically designed to work safely and efficiently with jar candles that are differ in size, shape and configuration from standard three inch apothecary jar candles. The venting chassis sits atop of the candle vessel supported by the mounting feet, which permits the inlet air flow underneath the venting chassis between the chassis top and the jar brim. The venting chassis has an annular skirt that extends below the jar shoulder that is formed between the sidewalls and jar brim. The skirt physically separates the inlet air flow from the exhaust air flow to facilitate laminar air flow within the jar candle. The skirt has three longitudinal depressions or channels, which form three inlet vents that open just below the jar shoulder. The skirt is shaped and configured to acts as a nozzle to constrain and directed the inlet airflow. The skirt constrains the inlet airflow through the inlet vents to increase the velocity and inertia of the airflow. The skirt is also sloped to vent the inlet airflow under jar shoulder directly onto jar sidewalls. The three inlet vents also channel the inlet airflow into distinct airflow columns Accordingly, an advantage of the venting chassis of this invention is that it is designed to function optimally with jar candles having small diameter mouths, jar candles with smaller sized jars than standard three inch apothecary candles, and oddly shaped, non-cylindrical jar candles.

Another advantage is that the venting chassis can be used safely with various jar candles.

Another advantage is that the shape and configuration of the skirt acts as a nozzle to constrain the inlet airflow thereby increasing the velocity and inertia of the airflow into the jar candle.

Another advantage is that the shape and configuration of the skirt also acts as a nozzle to vent the inlet air flow under the jar's shoulder directly onto the sidewalls thereby cooling the jar candle.

Other advantages will become apparent upon a reading of the following description.

BRIEF DESCRIPTION OF THE DRAWINGS

The preferred embodiments of the invention have been depicted for illustrative purposes only wherein.

DESCRIPTION OF THE PREFERRED EMBODIMENT

Figure 1:
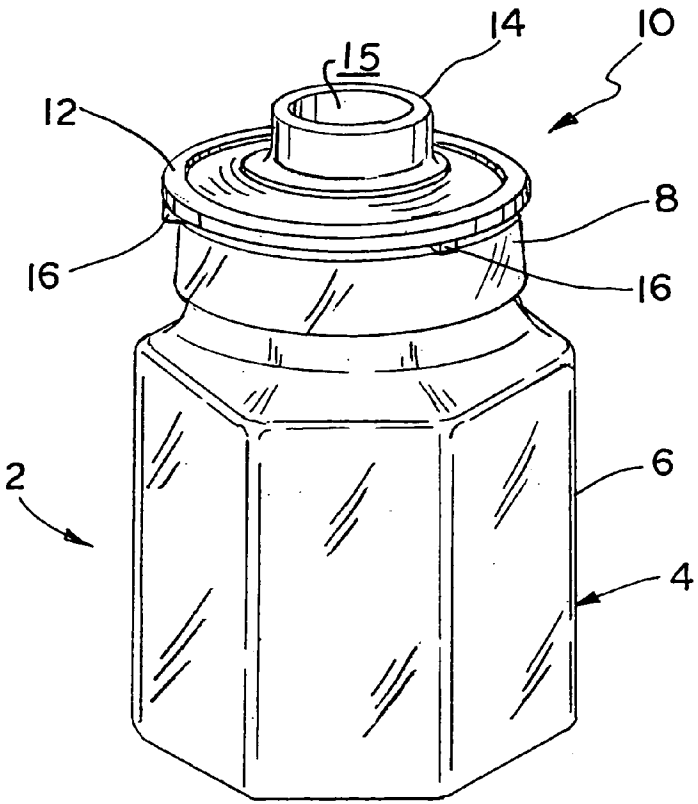
FIG. 1 is a perspective view of the venting chassis of this invention seated atop a jar candle.

The preferred embodiment herein described is not intended to be exhaustive or to limit the invention to the precise form disclosed. It is chosen and described to explain the invention so that others skilled in the art might utilize its teachings.

The figures illustrate the venting chassis of this invention, which is designated as reference numeral 10. As illustrated in FIGS. 1–4, venting chassis 10 sits atop a jar candle, which is designated generally as reference numeral 2. As shown, jar candle 2 includes a vessel or jar 4 filled with a quantity of wax and a cloth or porous wick. As shown, jar 4 has sidewalls 6 and an inset cylindrical brim around the open mouth 9. The inset between brim 8 and sidewalls 6 form an inner shoulder 7. Venting chassis 10 is specifically designed for use with jar candles other than standard three inch apothecary jar candles. Particularly, venting chassis 10 is intended for use with jar candles that have smaller mouths than the standard "three inch" apothecary jar candle (jar candles with mouth diameters less than 3.26 inches), and other jar candles that have oddly shaped, non-cylindrical or smaller sized jars. In addition, venting chassis 10 is designed to work optimally With vessels that have pronounced shoulders where the vessel sides converge to form the brims at the mouth of the vessel. For example, venting chassis 10 is well suited for use with the jar candles manufactured by Home Interiors and Gifts of Dallas Tex.

Venting chassis 10 facilitates laminar air flow within the jar candle to improve combustion efficiency. Venting chassis 10 also provides a substructure for various ornamentation (not shown) mounted atop the chassis. Typically, this ornamentation takes the form of a molded relief, which can be painted or otherwise adorned. The relief can be molded from a poly resin material or ceramic. Poly resin reliefs are preferable due to their durability and ease of production. The relief is molded and formed into aesthetically pleasing shapes and configurations and bonded to the top surface of the venting chassis using any suitable heat resistant adhesive. While an integral part of the venting chassis, the ornamentation is purely aesthetic and does not contribute directly to the function of the venting chassis.

Venting chassis 10 is constructed from any thermal insulating material, such as ceramic, glass, or a heat resistant plastic. Although, glass, ceramic and plastics being easily formed and molded are highly desirable construction materials, the venting chassis may also be constructed from other suitable materials without deviating from the principal teachings of this invention. The body of the chassis has sufficient thickness to thermally insulate any ornamentation from the maximum heat generated by a conventional apothecary jar candle when the flame is at its closest proximity to the venting chassis atop a jar candle. For ceramic construction, venting chassis 10 has a general thickness of at least 0.125 inches. As illustrated in the figures, venting chassis 10 has a circular configuration and a substantially flat top surface upon which ornamentation is affixed; however, the top of the venting chassis may be shaped and configured as aesthetically desirable and to accommodate any shape and configuration of jar candle.

As shown, venting chassis 10 includes a flat disc shaped top 12; a cylindrical chimney 14 around a central exhaust vent 15; three feet 16 which support the top above brim 8 of jar candle 2; and an inset skirt 20, which acts as a baffle to channel and direct inlet air flow along sidewalls 6 of candle jar 2. Feet 16 extend radially from skirt 20 to the outer edge of top 12 at equally spaced locations approximately 120 degrees apart. Mounting feet 16 support the venting chassis atop jar candle 2 such that top 12 is spaced vertically above jar brim 8. Feet 16 are dimensioned so as to create an air gap 17 at least 1/16 of an inch between venting chassis 10 and brim 8. As shown, exhaust vent 15 is positioned directly above the flame and has a diameter between 0.5 and 2.0 inches, which is generally ideal for venting exhaust air from the combustion of conventional candle wax. Typically, the cross sectional area of the exhaust vent 15 is approximately 0.785 square inches, that is chimney 14 having a 1.00 inch diameter, but may range between 0.700-0.900 square inches. This cross sectional area is generally ideal for venting exhaust air from the combustion of conventional four inch diameter apothecary jar candles. Chimney 14 extends at least 0.500 inches above the top surface of top 12.

Figure 3:
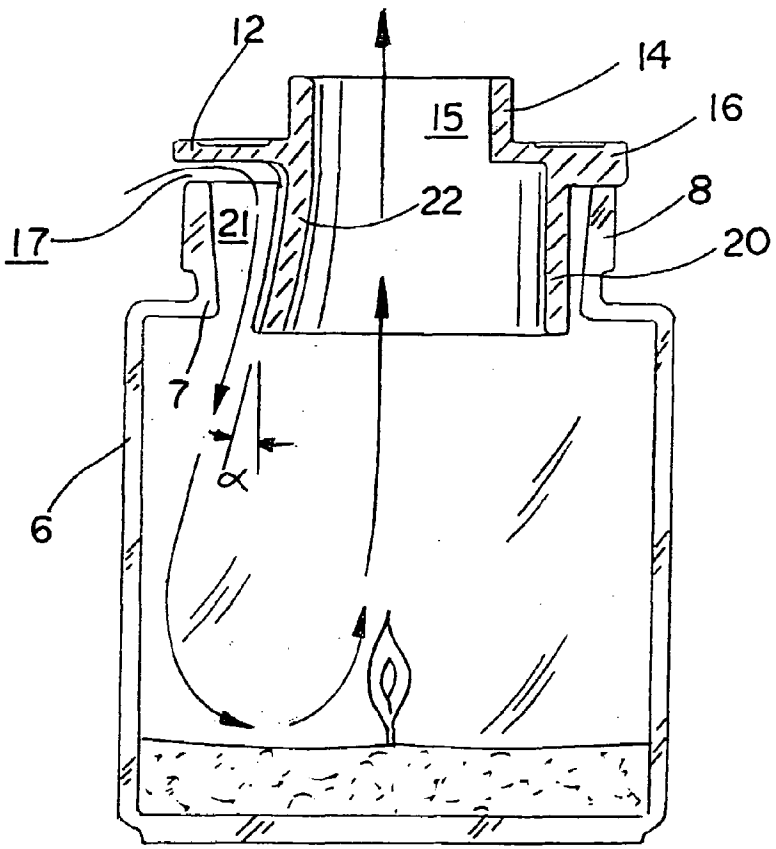
FIG. 3 is a side sectional view of the venting chassis of this invention seated atop a jar candle showing the wax burned down near the bottom of the jar.
Figure 2:
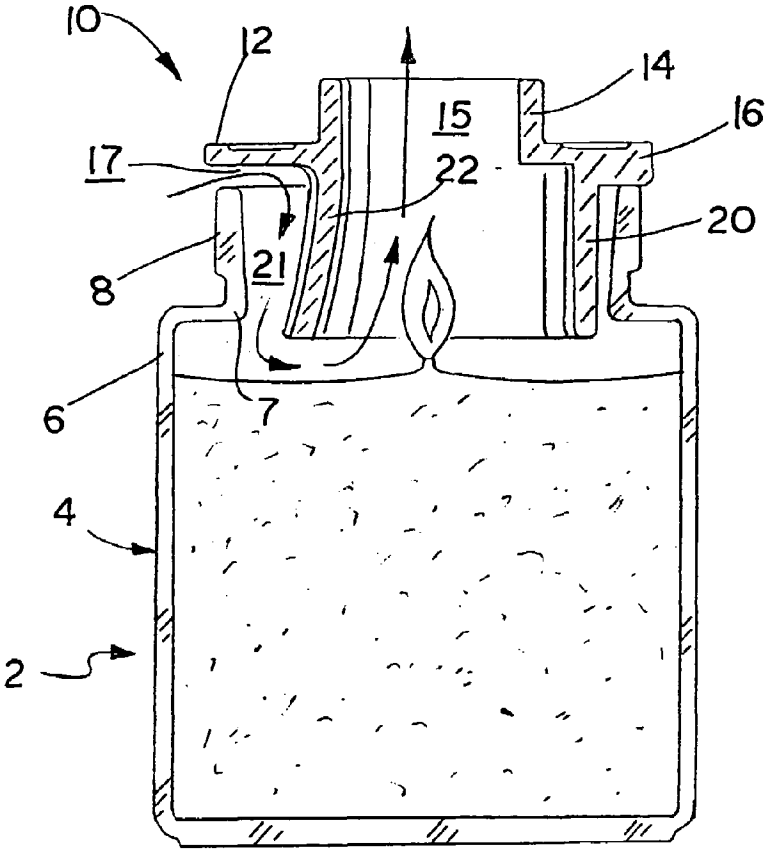
FIG. 2 is a side sectional view of the venting chassis of this invention seated atop a jar candle showing the jar filled with wax.
Figure 5:
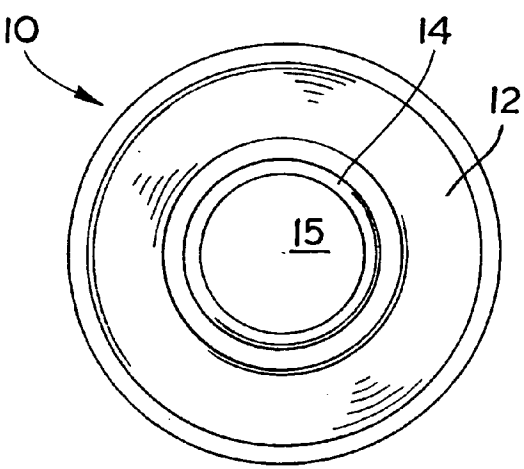
FIG. 5 is a top plan view of the venting chassis of this invention.
Figure 6:
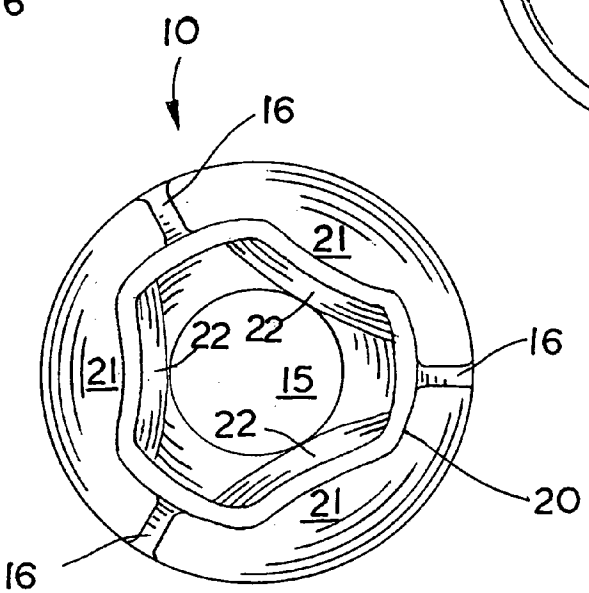
FIG. 6 is a bottom plan view of the venting chassis of this invention.
Figure 4:
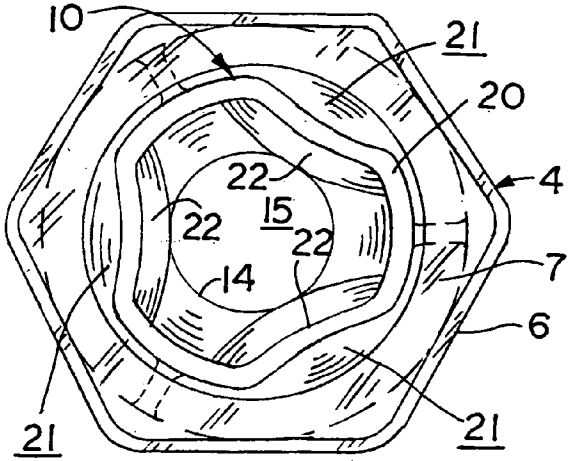
FIG. 4 is a top sectional view of the venting chassis and jar taken along line 4—4 of FIG. 3.

As best shown in FIGS. 2 and 3, skirt 20 extends downward from top 12 into mouth 7 below shoulder 7 of candle jar 2. Ideally, skirt 20 is dimensioned to extend at least 0.25 inches below shoulder 7 of jar candle 2. Skirt 20 is inset from the peripheral edge of top 12 and dimensioned to mirror the inner contour of brim 8, so as to prevent venting chassis 10 from moving about within the candle mouth. Skirt 20 has three longitudinal depressions or channels, which form three inlet vents 21 that open just below shoulder 7. As shown, the portion of the outer surface of skirt 20 (designated as reference numeral 22), which forms inlet vent 21, have a vertical concavity and is flared to slope outward at its bottom. The slope and contour of surface 22 acts as a nozzle with brim 8 to constrain and direct the inlet airflow. The shape and contour of surface 22 necks down the cross sectional area of inlet vent 21 toward the bottom of skirt 20, which constrains the inlet airflow through inlet vent 21. The slope of surface 22 vents inlet airflow through inlet vent 21 at a departure angle (theta) under shoulder 7 directly onto sidewalls 6.

Operation

FIGS. 2 and 3 illustrate the operation of the venting chassis 10. The thermal energy generated from the flame creates an upward convection flow of hot exhaust air, which exits the candle interior through the exhaust vent of chimney 14. Positioning exhaust vent 15 directly above the candle flame focuses the convection draft of exhaust airflow directly upwards, which reduces diffusion of the exhaust flow and its thermal energy. The negative pressure within the candle interior created by exhaust airflow draws an inlet airflow of cool ambient air underneath chassis 20 between top 22 and brim 8. The inlet airflow then vents downward through inlet vents 21, which columnate the inlet air flow into three distinct columns of air. As shown, inlet air flow enters candle jar 2 horizontally from underneath venting chassis 10 and is directed by the inclined sidewalls of skirt 20 downward and back toward vessel sidewall 12. The columns of inlet air move along the melted wax pool and converge at the base of the candle flame. Skirt 20 separates the opposing air flows (inlet and exhaust) to reduce turbulence within the jar interior and stabilize the flame, which leads to a cleaner combustion process and reduced carbon residue (smoke) in the exhaust.

Advantages

One skilled in the art will note several advantages of the venting chassis of this invention over the venting plates and chassis of U.S. Pat. Nos. 6,382,962, 6,585,510, 6,589,047, and 6,663,384. The venting chassis facilitates laminar air flow within the jar candle to improve combustion efficiency and also provides a substructure upon which various ornamentation is mounted. The annular skirt provides a physical barrier that reduces turbulence in containerized candles by separating concentric laminar air flow within the candle vessel, which enables sufficient ambient air flow directly to the base of the flame.

More importantly, the venting chassis of this invention can be used safely with jar candles having small diameter mouths, jar candles with smaller sized jars than standard three inch apothecary candles, and oddly shaped, non-cylindrical jar candles. The slope and contour of the skirt creates a nozzle effect that constrains and directs the inlet airflow vented into the candle interior. The nozzle effect, created by the skirt necking down the cross sectional area of the inlet vent through which the inlet airflow passes, increases the velocity and inertia of the inlet airflow. In addition, the nozzle effect ensures that inlet airflow is vented directly outward onto the jar sidewalls regardless of the shape or configuration of the jar. Because the skirt extends into the jar mouth below the shoulder, the inlet airflow can be vented under the shoulder and outward directly onto the sidewalls. Venting the inlet airflow directly onto the sidewalls of the jar, which help regulate the temperature of the jar candle. This ensures that the jar candle can be handled safely and reduces fire hazards. In addition, the skirt vents the inlet airflow into three distinct columns of inlet airflow, which results in an increased inlet air flow velocity across the wax pool. Increasing the velocity of the inlet air flow over the melted wax pool improves scent distribution.

It is understood that the above description does not limit the invention to the details given, but may be modified within the scope of the following claims.

I claim:

1. A combination comprising a containerized candle and a venting apparatus for improving the stability and efficiency of the combustion flame of the containerized candle, the containerized candle includes a vessel and a fuel source enclosed in the vessel and burnt in the flame, the vessel including sidewalls defining a vessel interior, a cylindrical vessel brim inset from the sidewalls and defining an open mouth to the vessel interior, and an integral vessel shoulder formed around the vessel brim where the sidewalls and the brim converge, the venting apparatus includes a plate shaped and dimensioned to overlie the open mouth of the vessel and extend over the vessel brim, the plate having an outer edge and a central exhaust vent therein for venting an exhaust airflow from the vessel interior:

a plurality of feet extending downward from the plate for spacing the plate above the vessel brim when the venting apparatus is seated atop the vessel to create an air gap between the plate and the vessel brim whereby an inlet airflow passes through the air gap when the containerized candle is burnt; and an annular baffle extending downward from the plate between the edge and the exhaust vent so as to extend downward into the open mouth of the vessel below the vessel shoulder when the apparatus is seated atop the vessel, the baffle having portions thereof contoured to have a vertical concavity that slopes outward from the plate beneath the vessel shoulder so as to form three longitudinal depressions, the longitudinal depressions constitute three inlet vents for constraining the inlet airflow into three distinct airflow columns and directing the inlet airflow columns under the vessel shoulder onto the vessel sidewalls when the containerized candle is burnt.

2. The combination of claim 1 wherein the baffle constitutes means for separating the inlet airflow from the exhaust airflow when the candle is burnt.

3. The combination of claim 1 wherein the portions of the baffle are sloped between ten and twenty degrees.

* * * * *